US006386961B1

(12) United States Patent
Cureton

(10) Patent No.: US 6,386,961 B1
(45) Date of Patent: May 14, 2002

(54) HAND HELD GRINDER

(76) Inventor: Thomas D. Cureton, 320 E. Edison, Williams, AZ (US) 86046

( * ) Notice: Subject to any disclaimer, the term of this patent is extended or adjusted under 35 U.S.C. 154(b) by 57 days.

(21) Appl. No.: 09/613,668

(22) Filed: Jul. 11, 2000

Related U.S. Application Data

(60) Provisional application No. 60/144,172, filed on Jul. 19, 1999.

(51) Int. Cl.[7] ..... B24B 27/08

(52) U.S. Cl. ..... 451/358; 451/359; 451/354

(58) Field of Search ..... 451/344, 354, 451/356, 357, 358, 359, 352, 353

(56) References Cited

U.S. PATENT DOCUMENTS

| | | | | |
|---|---|---|---|---|
| 1,391,221 | A | | 9/1921 | Tuttle |
| 1,947,324 | A | | 2/1934 | Zerbee |
| 1,971,790 | A | | 8/1934 | Mall |
| 2,736,048 | A | | 5/1956 | Gregoire |
| 3,885,355 | A | | 5/1975 | Kakimoto |
| 4,322,921 | A | * | 4/1982 | Maier |
| 4,660,329 | A | * | 4/1987 | Hutchins |
| 5,218,790 | A | * | 6/1993 | Huang |
| 5,458,533 | A | * | 10/1995 | Barth et al. ..... 451/357 |
| 5,564,969 | A | | 10/1996 | Tsang |
| 5,588,903 | A | | 12/1996 | Pennison |
| 5,601,483 | A | | 2/1997 | Rudolf et al. |
| 5,718,621 | A | | 2/1998 | Turley |
| 5,727,994 | A | | 3/1998 | Sjolander et al. |
| D396,175 | S | * | 7/1998 | Chung ..... D8/62 |
| 5,839,948 | A | | 11/1998 | Kronberg |
| 5,839,950 | A | | 11/1998 | Johansson Edling et al. |
| 5,879,228 | A | * | 3/1999 | Sun ..... 451/357 |
| 6,004,194 | A | | 12/1999 | Hild et al. |
| 6,007,412 | A | * | 12/1999 | Hutchins ..... 451/295 |

* cited by examiner

*Primary Examiner*—Timothy V. Eley
(74) *Attorney, Agent, or Firm*—Schmeiser, Olsen & Watts

(57) ABSTRACT

A hand-held grinder includes a motor and a mounting surface coupled to the motor. A housing supports the mounting surface and the motor. A grinding wheel abuts and is secured to the mounting surface, and the grinding wheel extends beyond an end of the housing. A line that is tangential with the grinding wheel distal from the housing, and that is tangential with the end of the housing, may be at an angle of less than about 45° relative to a plane of rotation of the grinding wheel. The grinder may also include a drive shaft coupled to the motor, a driving gear coupled to the drive shaft, and a driven gear engaging the driving gear and fixed to the mounting surface. The driven gear and the mounting surface may be part of a unitary member. The housing may define a bottom housing surface that is substantially coplanar with the mounting surface. The housing may also define a tapered end. The grinder may also include a telescoping feature wherein the housing includes a first member that is moveable relative to a second member to change a length of the grinder. The grinder may include a lock pin that may be selectively forced into engagement with the drive shaft, thereby preventing rotation of the drive shaft relative to the housing.

26 Claims, 3 Drawing Sheets

HAND HELD GRINDER

RELATED APPLICATION

This application claims the benefit of U.S. Provisional Application No. 60/144,172, entitled NINETY DEGREE ANGLE GRINDING TOOL filed Jul. 19, 1999.

BACKGROUND OF THE INVENTION

1. Technical Field

This invention generally relates to a grinder, and more specifically relates to a compact grinder.

2. Background Art

Hand held grinders are common tools that are used for a variety of applications. Typically a grinder includes a motor that drives a wheel (such as a grinding wheel, wire brush, or cutting disc). Many grinders include a drive shaft from the motor and a gear system coupled to the drive shaft that changes the direction of rotation. Often the direction of rotation is changed by 90°. Also, many grinders include a lock pin that can be pressed inwardly to lock the drive shaft relative to the housing of the grinder so that a clamping screw can be loosened or tightened to mount the wheel on the grinder or remove the wheel from the grinder.

Hand held grinders are useful because they are portable and thus the grinders can be taken to the part to be worked, rather than the part having to be moved to a stationary grinder. They are often useful in working surfaces of large or bulky machines or parts. As such, they are often used in automobile repair, metal fabrication, welding shops, heavy equipment repair, and woodworking. However, past hand held grinders have not been able to reach many surfaces or they have required excessive work or modification to reach many surfaces.

DISCLOSURE OF INVENTION

Therefore, there existed a need to provide a hand held grinder that is compact and that is able to work hard-to-reach surfaces such as inside corners. The present invention recognizes this need, which has not heretofore been recognized and addressed.

According to the present invention, a hand-held grinder includes a motor and a mounting surface coupled to the motor. A housing supports the mounting surface and the motor. A grinding wheel abuts and is secured to the mounting surface, and the grinding wheel extends beyond an end of the housing. A line that is tangential with the grinding wheel distal from the housing, and that is tangential with the end of the housing, may be at an angle of less than about 45° relative to a plane of rotation of the grinding wheel.

The grinder may also include a drive shaft coupled to the motor, a driving gear coupled to the drive shaft, and a driven gear engaging the driving gear and fixed to the mounting surface. The driven gear and the mounting surface may be part of a unitary member. Such a unitary construction allows the grinder to be more compact.

The housing may define a bottom housing surface that is substantially coplanar with the mounting surface. This substantially coplanar construction allows the grinder to be constructed so that only a very small gap separates the grinding wheel from the housing, thereby producing a more compact grinder. The housing may also define a top housing surface opposite from the bottom housing surface and an angled housing surface between the bottom housing surface and the top housing surface that forms an acute angle with the bottom housing surface, thereby forming a tapered end of the housing. The tapered end further adds to the compact design of the grinder and particularly aids in allowing the grinder to reach tight spaces such as inside corners.

Also, the grinder may include a telescoping feature wherein the housing includes a first member and a second member. The first member is moveable relative to the second member to change a length of the grinder. The telescoping feature is desirable because some hard-to-reach surfaces require a longer tool while others require a shorter tool. The telescoping feature allows a single grinder to access both types of surfaces.

The grinder may include a lock pin supported by the housing that is aligned with, but generally biased away from, a radial hole in the drive shaft. The lock pin may be selectively forced into engagement with the radial hole, thereby preventing rotation of the drive shaft relative to the housing. The lock pin locks the rotating parts of the grinder relative to the housing so that a clamping screw can be tightened or loosened to secure or remove a wheel from the grinder. Without the lock pin, a user would have to directly access the mounting surface or other moving parts of the grinder—this would likely require extending such parts beyond the grinder housing to make them accessible.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements.

MODES FOR CARRYING OUT THE INVENTION

Figure 1:
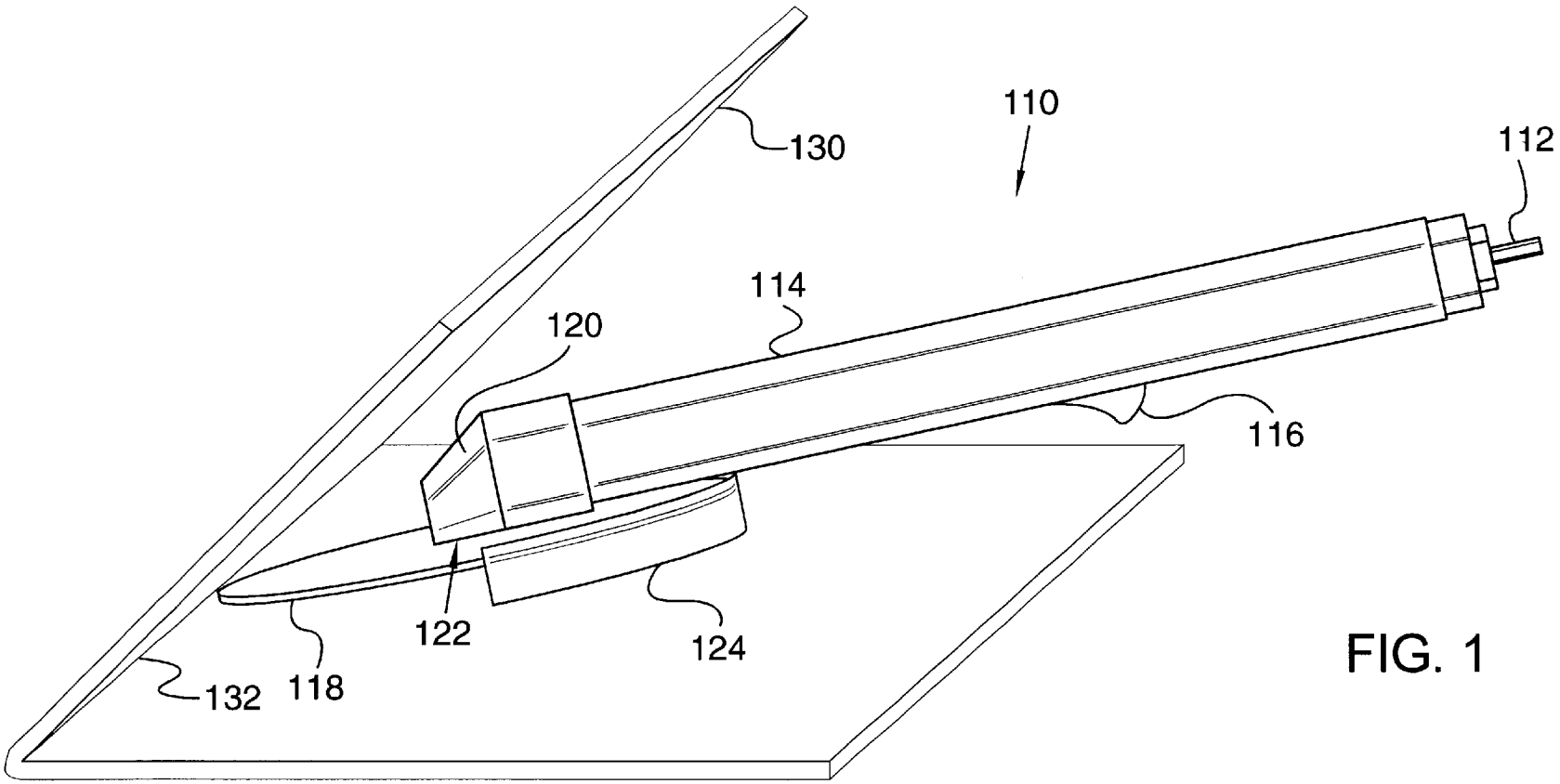
FIG. 1 is an isometric view of a grinder according to an embodiment of the present invention working an inside corner.

Referring to FIG. 1, a grinder 110 includes a power input 112 that is housed within a housing 114. In the embodiment shown, the grinder is a pneumatic grinder and the power input is a fitting for attaching grinder 110 to an air hose that supplies pressurized air to grinder 110. However, the present invention is also well-suited to grinders that are powered by other power sources, such as electric power sources. Power input 112 communicates pressurized air to a motor (not shown) that is also housed within housing 114. A trigger mechanism 116 preferably activates the motor when it is depressed by a user and deactivates the motor when it is not depressed. The motor is preferably mechanically coupled to a grinding wheel 118 that extends beyond an end 120 of housing 114. End 120 is preferably tapered, and grinding wheel 118 is preferably parallel with and very close to a bottom surface 122 of housing 114. A shield 124 is attached to grinder 110 and protects a user from contact with wheel 118 and from sparks or other material being propelled rearwardly from wheel 118 during use.

Grinder 110 is particularly suited to work material in hard-to-reach places, such as inside corners that are not accessible with prior hand held grinders. In FIG. 1, grinder 110 is shown working a part 130 on an inside comer 132. Preferably, grinder 110 is able to reach inside corners having angles as small as 45°. Thus, a line that is tangential to grinding wheel 118 distal from housing 114, and that is tangential to end 120 of housing 114 preferably forms an angle of less than about 30° with a plane of rotation of grinding wheel 118 and bottom surface 122. However, the line may form an angle of less than about 45° with the plane of rotation of grinding wheel 118 and bottom surface 122. These small angles are possible because of the shape of housing 114 and because of the structure of the interior parts of grinder 110, which will be described below.

Figure 2:
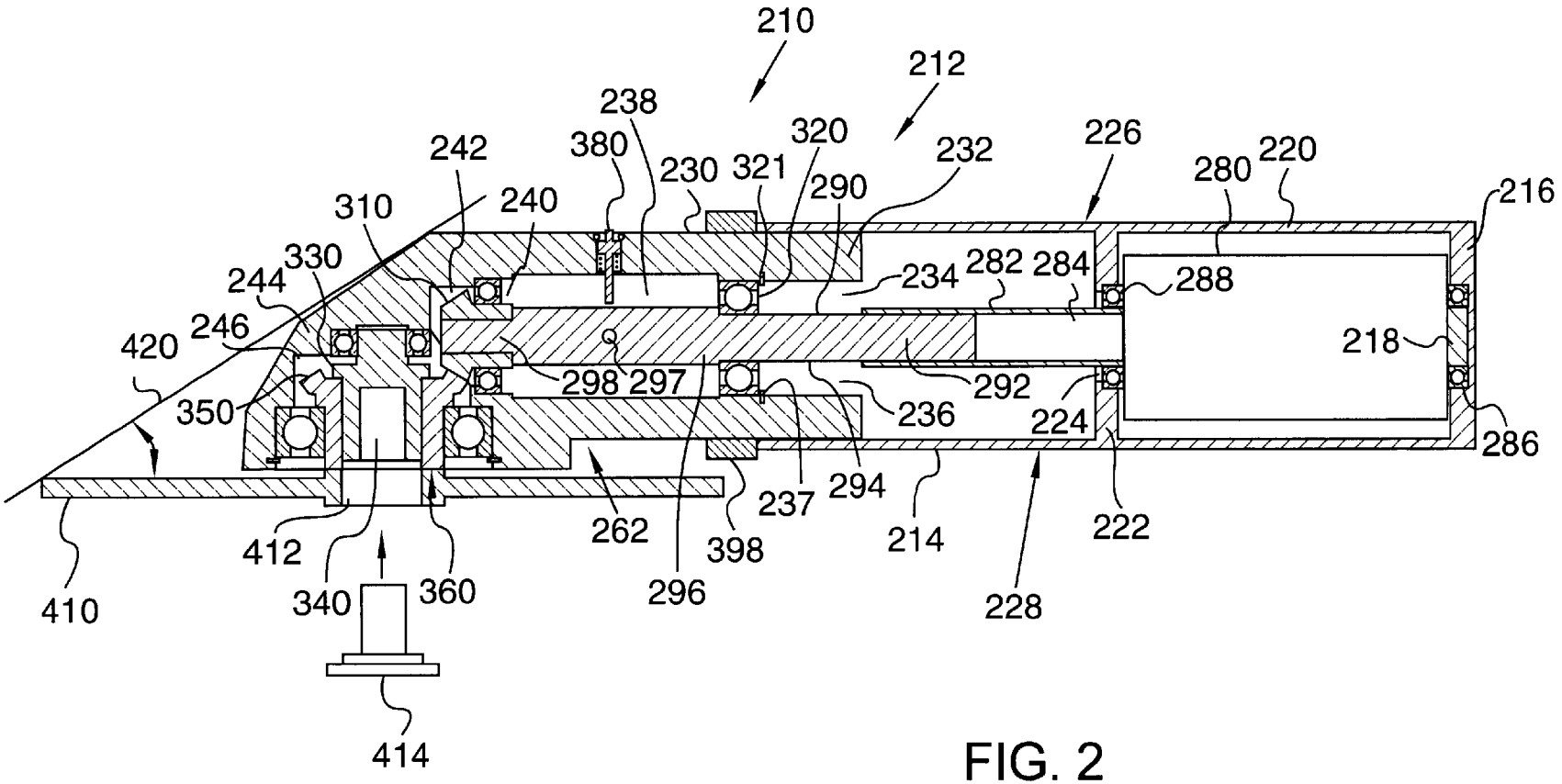
FIG. 2 is a sectional view of a grinder according to an embodiment of the present invention.

Referring now to FIG. 2, a grinder 210 includes a housing 212 that includes a first member or motor housing 214. Motor housing 214 includes a first radial wall 216 that defines a centrally located recess 218 therein. A circumferential wall 220 extends axially from the periphery of first radial wall 216. A second radial wall 222 extends radially inwardly from circumferential wall 220, thereby defining a chamber in motor housing 214. A two tiered hole 224 in second radial wall 222 forms an opening of the chamber. Circumferential wall 220 forms the handle of grinder 210, and includes a top side 226 and an opposing bottom side 228.

Figure 3:
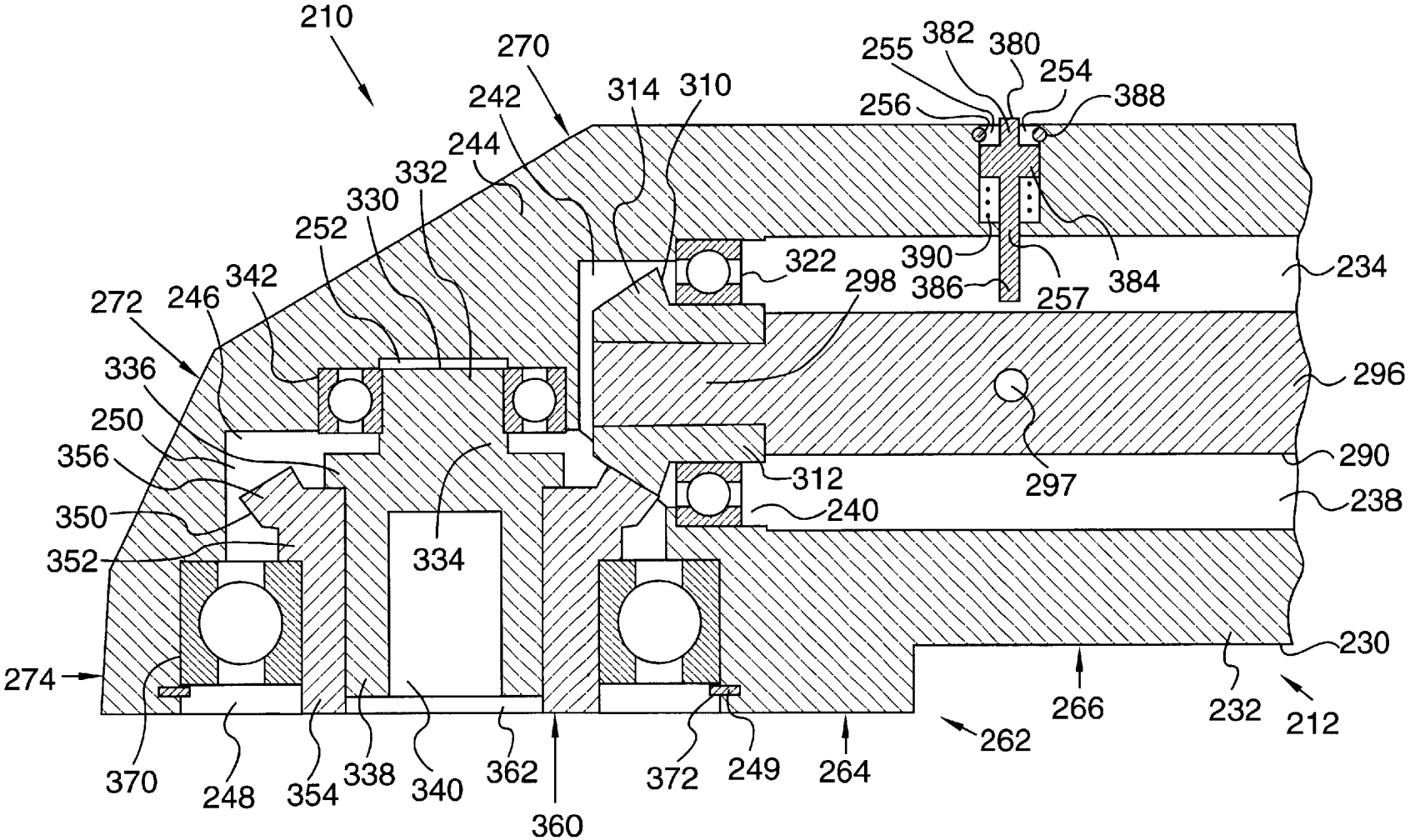
FIG. 3 is a broken away sectional view of the head of the grinder of FIG. 2.

Referring now to FIGS. 2–3, housing 212 also preferably includes a second member or gear housing 230. Gear housing 230 preferably includes a circumferential wall 232 that slidingly fits within circumferential wall 220 of motor housing 214. A first aperture 234 extending within circumferential wall 232 preferably includes four cylindrical tiers or four regions having different diameters. A first tier 236 extends axially into gear housing 230 from the terminus of circumferential wall 232, and an annular recess 237 extends radially outwardly from first tier 236. A second tier 238 extends axially from first tier 236 and preferably has a slightly larger diameter than first tier 236. A third tier 240 extends axially from second tier 238 and has a slightly smaller diameter than second tier 238. A fourth tier 242 extends axially from third tier 240 and has a smaller diameter than third tier 240.

Referring to FIGS. 2–3, a sloped wall 244 forms an end of gear housing 230. Sloped wall 244 slopes downwardly from the top of gear housing 230 to the bottom of gear housing 230 so that gear housing 230 has a generally tapered end. A second cylindrical aperture 246 is defined by circumferential wall 232 and sloped wall 244. Second cylindrical aperture 246 includes a first cylindrical tier 248 that extends upwardly from the bottom of gear housing 230. An annular recess 249 extends into the wall of first tier 248 and faces radially inwardly. A second tier 250 extends upwardly from first tier 248 and has a smaller diameter than first tier 248. Second tier 250 of second aperture 246 intersects fourth tier 242 of first aperture 234 so that first aperture 234 and second aperture 246 intersect to form a hole extending through gear housing 230. Second aperture 246 extends upwardly from second tier 250 to form a cylindrical recess 252 that has a smaller diameter than second tier 250.

A two tiered cylindrical aperture 254 extends downwardly through the top side of gear housing 230 and into second tier 238 of first aperture 234. A first tier 255 extends downwardly, and an annular recess 256 extends radially outwardly from first tier 255. A second tier 257 extends downwardly from first tier 255 and communicates with second tier 238 of first aperture 234.

A bottom surface 262 of gear housing 230 includes a wheel portion 264 that is generally flat and that surrounds the bottom of second aperture 246. A cylindrical portion 266 of bottom surface 262 is preferably located upwardly of wheel portion 264, although the bottom of cylindrical portion 266 may be in substantially the same plane as wheel portion 264.

A first angled surface 270 angles downwardly from the top of gear housing 230. Preferably first angled surface 270 forms an angle with wheel portion 264 of bottom surface 262 of about 30°. A second angled surface 272 angles downwardly from first angled surface 270 and preferably forms an angle with wheel portion 264 of about 65°. An end surface 274 extends downwardly from second angled surface 272 and meets wheel portion 264 of bottom surface 262. Although the surfaces of end 244 of gear housing 230 have been described above in detail, many other possibilities would allow the generally tapered shape of end 244 that is preferred in the present invention. For example, end 244 could include a single arcuate surface, rather than 3 distinct surfaces.

Referring back to FIG. 2, a motor 280 is preferably seated within the chamber of motor housing 214 and fixed to motor housing 214. In a working model, motor 280 is a 0.6 horsepower pneumatic motor having an output speed of about 25,000 revolutions per minute. However, it would likely be desirable to have a more powerful motor for many applications. A motor shaft 282 extends from motor 280 and through hole 224 in second radial wall 222. Motor shaft 282 also extends from motor 280 into recess 218. Motor shaft 282 preferably includes inwardly facing engaging elements 284 that are preferably axially extending splines. A first motor bearing 286 is preferably seated within recess 218 and receives an end of motor shaft 282. A second motor bearing 288 is preferably seated within hole 224 so that it abuts the shoulder between the two tiers of hole 224. Motor bearing 288 also receives motor shaft 282. Thus motor shaft 282 is supported by motor housing 214 and motor bearings 286, 288, but bearings 286, 288 allow motor shaft 282 to rotate independently of motor housing 214.

A drive shaft 290 includes a first tier 292 that defines outwardly facing engaging elements or splines 294 that engage inwardly facing splines 284 of motor shaft 282, thereby coupling drive shaft 290 to motor shaft 282. However, splines 294 and splines 284 are able to slide axially relative to each other, thereby allowing drive shaft 290 to slide relative to motor shaft 282.

Drive shaft 290 also includes a second tier 296 having a larger diameter than first tier 292. Second tier 296 defines a centrally located radially extending hole 297. Hole 297 is axially aligned with second tier 257 of two tiered aperture 254 and has a diameter that is approximately equal to the diameter of hole 297 (see FIG. 3). A third tier 298 of drive shaft 290 extends from second tier 296 and has a diameter that is smaller than the diameter of second tier 296.

A driving gear 310 is mounted on third tier 298 of drive shaft 290. Referring to FIG. 3, driving gear 310 includes a circumferential wall 312 that extends around third tier 298, and circumferentially spaced teeth or engaging elements 314 extending outwardly from circumferential wall 312. Driving gear 310 is preferably a spiral bevel gear. In a working embodiment of the invention, driving gear 310 is a gear sold under the registered trademark BOSTON and having a model number SH302P from IMO Industries, Inc. of Lawrenceville, N.J.

Referring back to FIG. 2, a drive shaft bearing 320 is seated within first tier 236 of first aperture 234 of gear housing 230 adjacent to second tier 238. Bearing 320 receives first tier 292 of drive shaft 290 and abuts the shoulder separating first tier 292 from second tier 296. Bearing 320 may be any of several types of bearings, but in a working model bearing 320 is a bearing sold under the registered trademark MPB and under the model number R4 by MPB Corporation of Keene, N.H. A retainer ring 321 engages annular recess 237 and abuts bearing 320 to hold bearing 320 in place.

Referring back to FIG. 3, a driving gear bearing 322 is seated within third tier 240 of first aperture 234 abutting the shoulder separating third tier 240 from fourth tier 242. Bearing 322 receives circumferential wall 312 of driving gear 310. Bearing 322 may be any of several types of bearings, but in a working model bearing 322 is a bearing sold under the registered trademark MPB and under the model number 610 by MPB Corporation of Keene, N.H. Thus, drive shaft 290 and driving gear 310 are supported by bearings 320, 322, but are able to rotate freely within gear housing 230 (see also FIG. 2).

A pilot shaft 330 includes a first cylindrical tier 332 within recess 252 in second aperture 246. A second cylindrical tier 334 extends downwardly from first tier 332 and has a larger diameter than first tier 332. A third cylindrical tier 336 extends downwardly from second tier 334 and has a larger diameter than second tier 334, and a fourth cylindrical tier 338 extends downwardly from third tier 336 and has a smaller diameter than third tier 336. A downwardly-facing threaded hole 340 extends upwardly within fourth tier 338. A pilot bearing 342 is seated within recess 252 and receives first tier 332 of pilot shaft 330.

A driven gear 350 preferably includes a first cylindrical tier 352 and a smaller diameter second cylindrical tier 354 extending downwardly from first tier 352. Circumferentially spaced engaging members or teeth 356 extend from first tier 352 and engage teeth 314 of driving gear 310. The downwardly-facing terminus of second tier 354 defines a mounting surface 360, and a hole 362 extends axially from mounting surface 360 upwardly through driven gear 350. Hole 362 receives fourth tier 338 of pilot shaft 330 and the shoulder between fourth tier 338 and third tier 336 of pilot shaft 330 preferably abuts the upper terminus of first tier 352 of driven gear 350. Driven gear 350 may be any of several types of gears so long as it is able to engage the corresponding driving gear 310. In a working model, driven gear 350 is a spiral bevel gear sold under the trademark BOSTON and the model number SH302G from IMO Industries, Inc. of Lawrenceville, N.J. In the working model described, the combination of driving gear 310 and driven gear 350 produce a 2 to 1 reduction so that if driving gear 310 is rotating at about 25,000 revolutions per minute then driven gear 350 will rotate at about 12,500 revolutions per minute. It may be desirable for a motor of this speed to have a lower reduction ratio, such 1.5 to 1.

A driven gear bearing 370 is seated within first tier 248 of second cylindrical aperture 246. Driven gear bearing 370 receives second tier 354 of driven gear 350 and abuts the shoulder separating first tier 352 from second tier 354 of driven gear 350. A retaining ring 372 engages annular recess 249 of second aperture 246 and abuts driven gear bearing 370. Driven gear bearing 370 may be any of several types of suitable bearings, such as a bearing sold under the registered trademark MPB and the model number 1219 available from MPB Corporation of Keene, N.H.

Referring still to FIG. 3, a lock pin 380 includes a cylindrical head 382 and a flange 384 below head 382. Flange 384 and head 382 are within first tier 255 of aperture 254. A shaft 386 of lock pin 380 extends downwardly from flange 384, through second tier 257 of aperture 254 and into second tier 238 of first aperture 234. Shaft 386 is of such a diameter that it is capable of sliding into engagement with hole 297 of drive shaft 290. A retaining ring 388 engages annular recess 256 and prevents flange 384 from exiting aperture 254. A return spring or biasing member 390 abuts the shoulder between first tier 255 and second tier 257 of aperture 254 and extends upwardly to abut flange 384 of lock pin 380 thereby biasing lock pin 380 upwardly and out of engagement with hole 297 of drive shaft 290.

Referring back to FIG. 2, a lock nut 398 preferably threadably engages the end of circumferential wall 220 of motor housing 214, such that tightening lock nut 398 reduces the diameter of the end of motor housing 214, thereby forming an interference fit between circumferential wall 220 of motor housing 214 and circumferential wall 232 of gear housing 230. Such an interference fit selectively fixes motor housing 214 to gear housing 230.

A working wheel 410, such as a grinding wheel, a wire brush, a cutting disc or another wheel that may be rotated to work a surface, abuts mounting surface 360. Wheel 410 defines a centrally located hole 412 that is preferably coaxial with threaded hole 340 of pilot shaft 330 and hole 362 of driven gear 350 (see also FIG. 3). A clamping screw 414 abuts wheel 410 and extends through hole 412 of wheel 410 and into engagement with threaded hole 340 of pilot shaft 330. Wheel 410 preferably is parallel with mounting surface 360 and bottom surface 262 of gear housing 230. Thus, wheel 410 preferably rotates in a plane that is parallel with mounting surface 360 and bottom surface 262 of gear housing 230.

Also, preferably a line 420 that is tangential to wheel 410 distal from gear housing 230 and that is tangential to a top of gear housing 230 forms an acute angle with the plane of rotation of wheel 410. More preferably, the acute angle is less than about 45°, and most preferably the acute angle is less than about 30°. Such an angle between gear housing 230 and wheel 410 allows wheel 410 to access hard-to-reach areas such as inside corners having angles as small as 45° or even less. In a working embodiment, wheel 410 is a 4 inch grinding wheel, although wheel 410 may be any of several other wheels, such as a 3 inch wheel or a 5 inch wheel.

Referring to FIG. 3, mounting surface 360 is preferably substantially coplanar with wheel portion 264 of bottom surface 262. Preferably, mounting surface 360 is within about 0.1 inch of being coplanar with wheel portion of bottom surface 262 and more preferably mounting surface 360 is within about 0.01 inch of being coplanar with wheel portion of bottom surface 262.

Referring to FIGS. 2–3 and describing the manufacturing and assembly of grinder 210, motor housing 214 and gear housing 230 are preferably made from aluminum. Motor housing 214 and gear housing 230 may be machined out of billet aluminum. If large quantities are to be produced, it may be preferable to die cast motor housing 214 and gear housing 230.

Shafts 282, 290, and 330; lock pin 380; and retaining rings 388, 372 are preferably made from steel by conventional manufacturing methods. Lock nut 398 is preferably made from aluminum by conventional manufacturing methods. Also, many conventional features, such as keys, retaining rings, etc. are not shown or described herein, but will be appreciated by those skilled in the art.

In assembling grinder 210, the portions of grinder 210 housed within gear housing 230 and motor housing 214 are assembled separately, and then the two assemblies are combined. In assembling the portion of grinder 210 within motor housing, preferably radial wall 216 is removed and motor 280 is placed within the chamber of motor housing 214 and motor shaft 282 is pressed into second motor bearing 288. First motor bearing 286 is pressed onto motor shaft 282 and into recess 218 of motor housing 214 and radial wall 216 is fixed to circumferential wall 220. Radial wall 216 may be securable to circumferential wall 232 by threaded engagement or by some other conventional fastening method. Also, air fittings that are not shown are preferably secured to radial wall 216 and communicate with motor 280. Lock nut 398 is loosely turned onto the end of circumferential wall 220.

In assembling the portion of grinder 210 within gear housing 230, pilot bearing 342 is pressed onto pilot shaft 330 and is pressed into recess 252 of second aperture 246. Driven gear 350 is pressed onto pilot shaft 330 and driven gear bearing 370 is pressed onto driven gear 350 and into first tier 248 of second aperture 246. Retaining ring 372 is then placed into engagement with annular recess 249 of second aperture 246.

Driving gear 310 is pressed onto drive shaft 290 and secured thereto, such as by a key. Driving gear bearing 322 is pressed onto driving gear 310 and is pressed into third tier 240 of first aperture 234 so that teeth 314 of driving gear 310 engage and interlock with teeth 356 of driven gear 350. Drive shaft bearing 320 is pressed onto first tier 292 of drive shaft 290 and within first tier 236 of first aperture 234. Retainer ring 321 is placed into engagement with annular recess 237 to hold bearing 320 in place.

The locking mechanism for locking rotational movement of drive shaft 290 is assembled by placing spring 390 within first tier 255 of aperture 254, inserting lock pin 380 into aperture 254, and placing retaining ring 388 into engagement with annular recess 256.

Motor housing 214 and gear housing 230 are attached by sliding circumferential wall 220 of motor housing 214 over circumferential wall 232 of gear housing 230 so that drive shaft 290 slides within motor shaft 282. Lock nut 398 is then tightened to clamp circumferential wall 220 of motor housing 214 onto circumferential wall 232 of gear housing 230.

To secure a wheel 410 to grinder 210, lock pin 380 is pressed downwardly into engagement with hole 297 in drive shaft 290, thereby preventing rotational movement of drive shaft 290 and thus pilot shaft 330 and mounting surface 360. Wheel 410 is then placed so that it abuts mounting surface 360 and so that hole 412 is aligned with threaded hole 340. Clamping screw 414 is then turned into threaded hole 340 until it is tight and secures wheel 410 to mounting surface 360 and pilot shaft 330. Lock pin 380 is then released and spring 390 biases lock pin 380 out of engagement with hole 297, thereby allowing drive shaft 290 to move freely within gear housing 230. The user may then operate grinder 210 to work a surface.

To remove a wheel 410 from grinder 210, lock pin 380 is pressed downwardly into engagement with hole 297 in drive shaft 290, thereby preventing rotational movement of drive shaft 290 and thus pilot shaft 330 and mounting surface 360. Clamping screw 414 is then turned out of threaded hole 340 and wheel 410 is removed.

A user may telescope motor housing 214 and gear housing 230 to reduce or increase the overall length of grinder 210. A user first turns lock nut 398 to loosen circumferential wall 220 of motor housing 214 from circumferential wall 232 of gear housing 230. Gear housing 230 and motor housing 214 may then be slid relative to each other to produce the desired length. A user then turns lock nut 398 to again clamp circumferential wall 220 of motor housing 214 onto circumferential wall 232 of gear housing 230. The user may then operate grinder 210 to work a surface. Heretofore, the advantage of different length grinders has not been recognized and most grinders have been made in standard lengths. Such standard length grinders are often inadequate in reaching surfaces to be worked by the grinders. The telescoping feature is desirable because some hard-to-reach surfaces require a longer tool while others require a shorter tool. With grinder 210, a single tool can access both types of surfaces. The extended and collapsed lengths of grinder 210 could be any reasonable combination of lengths that would allow the grinder to be easily manipulated by hand.

The compact design of grinder 210 is made possible by several unique features described above. For example, driven gear 350 and mounting surface 360 are both part of a unitary member that is preferably a homogenous steel part that can be cut from billet steel. In other hand held grinders the mounting surface is typically separate from, although fixed to, the driven gear. Also, mounting surface 360 is substantially coplanar with wheel portion 264 of bottom surface 262. Thus, in a preferred embodiment, wheel 410 is only about 0.01 inch from wheel portion 264 of bottom surface 262, although it may be as much as 0.1 inch from wheel portion 264. The 0.01 inch gap is typically due to a slight offset between wheel portion 264 and mounting surface 360 and/or a slight offset between the center of wheel 410 and the remainder of wheel 410.

Lock pin 380 also aids in keeping grinder 210 as compact as possible. Lock pin 380 fixes mounting surface 360 and pilot shaft 330 relative to gear housing 230 while clamping screw 414 is tightened or loosened. Otherwise, a user would have to directly access mounting surface 360, driven gear 350, or pilot shaft 330 while tightening or loosening clamping screw 414—this would require mounting surface 360 to extend downwardly below the surrounding wheel portion 264 of bottom surface 262 of gear housing 230. Accordingly, the unique features of the present invention produce a grinder that is extremely compact and that is able to reach difficult-to-access spaces such as inside comers.

While the invention has been particularly shown and described with reference to preferred embodiments thereof, it will be understood by those skilled in the art that various changes in form and details may be made therein without departing from the spirit and scope of the invention.

What is claimed is:

1. A hand-held grinder comprising:

a motor;

a mounting surface coupled to the motor;

a housing supporting the mounting surface and the motor; and a grinding wheel abutting the mounting surface and extending radially therefrom beyond an end of the housing, the grinding wheel being releasably secured to the mounting surface, such that the motor drives the grinding wheel;

wherein a line that is tangential with the grinding wheel distal from the housing and that is tangential with any point on the housing is at an angle of less than about 45° relative to a plane of rotation of the grinding wheel.

2. The grinder of claim 1, wherein the wheel is about 4 inches in diameter.

3. The grinder of claim 1, wherein the line is at an angle of less than about 300 relative to the plane of rotation of the grinding wheel.

4. The grinder of claim 1, further comprising a drive shaft coupled to the motor;

a driving gear coupled to the drive shaft; and a driven gear engaging the driving gear and fixed to the mounting surface;

wherein the driven gear and the mounting surface are part of a unitary member.

5. The grinder of claim 4, wherein the housing comprises a first member and a second member that is movable relative to the first member, and wherein movement of the second member relative to the first member changes a length of the grinder.

6. The grinder of claim 1, further comprising:

a drive shaft supported by the housing, the drive shaft coupled to the motor and to the mounting surface, and the drive shaft defining a radial hole; and a radially extending lock pin supported by the housing that is generally biased away from the radial hole but that is aligned with the radial hole, such that the lock pin may be selectively forced into engagement with the radial hole, thereby preventing rotation of the drive shaft relative to the housing.

7. The grinder of claim 1, wherein the housing defines a bottom housing surface that is substantially coplanar with the mounting surface.

8. The grinder of claim 7, wherein the bottom housing surface extends from the mounting surface toward the motor.

9. The grinder of claim 8, wherein a wheel portion of the bottom housing surface extends from the mounting surface and faces the grinding wheel.

10. The grinder of claim 8, wherein the housing further comprises:

a top housing surface opposite from the bottom housing surface; and a first angled housing surface between the bottom housing surface and the top housing surface, the angled housing surface forming a first acute angle with the bottom housing surface, and thereby forming a tapered end of the housing.

11. The grinder of claim 10, wherein the first acute angle is less than about 45°.

12. The grinder of claim 10, wherein the housing further comprises a second angled housing surface between the bottom housing surface and the top housing surface, the second angled housing surface being adjacent the first angled housing surface.

13. A hand-held grinder comprising:

a motor;

a drive shaft coupled to the motor;

a driving gear coupled to the drive shaft, wherein the driving gear is axially movable relative to the motor;

a driven gear engaging the driving gear;

a mounting surface fixed to the driven gear;

a grinding wheel abutting the mounting surface and extending radially therefrom, the grinding wheel being releasably secured to the mounting surface, such that the motor drives the grinding wheel; and a housing defining a bottom housing surface substantially parallel with the grinding wheel and substantially coplanar with the mounting surface, at least a portion of the bottom housing surface facing the grinding wheel;

wherein the driven gear and the mounting surface are part of a unitary member.

14. The grinder of claim 13, wherein the mounting surface is within about 0.1 inch of being coplanar with the bottom housing surface.

15. The grinder of claim 14, wherein the mounting surface is within about 0.01 inch of being coplanar with the bottom housing surface.

16. The grinder of claim 13, wherein the grinding wheel extends beyond an end of the housing, and wherein a line that is tangential with the grinding wheel distal from the housing, and that is tangential with any point on the housing, is at an angle of less than about 45° relative to a plane of rotation of the grinding wheel.

17. The grinder of claim 16, wherein the line is at an angle of less than about 30° relative to a plane of rotation of the grinding wheel.

18. The grinder of claim 13, further comprising:

a radial hole defined by the drive shaft; and a lock pin supported by the housing that is generally biased away from the radial hole but that is aligned with the radial hole, such that the lock pin may be selectively forced into engagement with the radial hole, thereby preventing rotation of the drive shaft relative to the housing.

19. The grinder of claim 13, wherein the bottom housing surface extends from the mounting surface toward the motor, and wherein the bottom housing surface comprises a wheel portion that extends from the mounting surface and faces the grinding wheel.

20. The grinder of claim 19, wherein a distance from the wheel portion to the grinding wheel is about 0.01 inch.

21. The grinder of claim 19, wherein the housing further comprises:

a top housing surface opposite from the bottom housing surface; and a first angled housing surface between the bottom housing surface and the top housing surface, the first angled housing surface forming a first acute angle with the bottom housing surface, and thereby forming a tapered end of the housing.

22. The grinder of claim 21, wherein the housing further comprises a second angled housing surface between the bottom housing surface and the top housing surface, the second angled housing surface being adjacent the first angled housing surface.

23. A hand-held grinder comprising:

a motor;

a drive shaft coupled to the motor, the drive shaft defining a radial hole;

a driving gear coupled to the drive shaft;

a driven gear engaging the driving gear;

a mounting surface fixed to the driven gear, the driven gear rotatable in a direction that is substantially normal to a direction of rotation of the driving gear;

a grinding wheel abutting the mounting surface and extending radially therefrom beyond an end of the housing, the grinding wheel being releasably secured to the mounting surface, such that the motor drives the grinding wheel;

a housing defining:

a bottom housing surface that is substantially coplanar with the mounting surface, the bottom housing surface extending from the mounting surface toward the motor, and the bottom housing surface comprising a handle portion that forms part of a handle of the grinder and a wheel portion that extends from the mounting surface and faces the grinding wheel;

a top housing surface opposite from the bottom housing surface;

a first angled housing surface between the bottom housing surface and the top housing surface, the first angled housing surface forming a first acute angle with the bottom housing surface; and a second angled housing surface between the bottom housing surface and the top housing surface, the second angled housing surface being adjacent the first angled housing surface and forming a second acute angle with the bottom housing surface; and a radially extending lock pin supported by the housing that is generally biased away from the radial hole but that is aligned with the radial hole, such that the lock pin may be selectively forced into engagement with the radial hole, thereby preventing rotation of the drive shaft relative to the housing;

wherein the driven gear and the mounting surface are part of a unitary member; and wherein a line that is tangential with the grinding wheel distal from the housing, and that is tangential with the housing, is at an angle of less than about 30° relative to a plane of rotation of the grinding wheel.

24. The grinder of claim 23, wherein the driving gear is axially movable relative to the motor.

25. The grinder of claim 24, further comprising a motor shaft that is coupled to the drive shaft and that is axially slidable relative to the drive shaft, such that sliding movement of the drive shaft relative to the motor shaft changes a length of the grinder.

26. The grinder of claim 25, further comprising a locking mechanism for selectively preventing axial movement of the drive shaft relative to the motor shaft.

* * * * *